US009469975B2

(12) United States Patent
Sheehan et al.

(10) Patent No.: US 9,469,975 B2
(45) Date of Patent: Oct. 18, 2016

(54) WEAR PAD ASSEMBLY

(71) Applicant: CATERPILLAR INC., Peoria, IL (US)

(72) Inventors: Paul Anthony Sheehan, Leicester Forest East (GB); Adrian Paul Forrester, Leicester (GB)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/368,543

(22) PCT Filed: Dec. 14, 2012

(86) PCT No.: PCT/US2012/069700

§ 371 (c)(1),
(2) Date: Jun. 25, 2014

(87) PCT Pub. No.: WO2013/101503

PCT Pub. Date: Jul. 4, 2013

(65) Prior Publication Data

US 2014/0373400 A1 Dec. 25, 2014

(30) Foreign Application Priority Data

Dec. 30, 2011 (GB) ..... 1122480.5

(51) Int. Cl.
*E02F 9/28* (2006.01)
*E02F 3/40* (2006.01)

(52) U.S. Cl.
CPC ..... *E02F 9/2883* (2013.01); *E02F 3/404* (2013.01)

(58) Field of Classification Search
CPC ..... E02F 3/8152; E02F 9/2883
USPC ..... 172/701.3, 719
See application file for complete search history.

(56) References Cited

U.S. PATENT DOCUMENTS

| | | | | | |
|---|---|---|---|---|---|
| 711,992 | A | * | 10/1902 | Mason, Jr. | 37/450 |
| 1,340,385 | A | * | 5/1920 | Edmondson | 37/455 |
| 1,543,222 | A | * | 6/1925 | McVeety | E02F 3/8152 172/701.3 |
| 2,705,380 | A | * | 4/1955 | Hensley | 172/778 |
| 2,837,844 | A | * | 6/1958 | Launder | 172/777 |
| 2,864,184 | A | * | 12/1958 | Fohr | 37/404 |
| 3,336,684 | A | | 8/1967 | Ulrich | |
| 3,426,460 | A | * | 2/1969 | Hinkel, Sr. et al. | 37/184 |
| 3,864,793 | A | * | 2/1975 | Guest | 24/569 |
| 3,885,833 | A | * | 5/1975 | Lemieux | 299/36.1 |

(Continued)

FOREIGN PATENT DOCUMENTS

| | | |
|---|---|---|
| CN | 101941475 | 1/2011 |
| CN | 201738352 | 2/2011 |

(Continued)

OTHER PUBLICATIONS

PCT Search Report.

(Continued)

*Primary Examiner* — Matthew D Troutman

(57) ABSTRACT

A wear pad assembly is configured to be quickly attached to a work tool in a non-permanent manner. The work tool includes first and second elements that are movable relative to each other from an open position to a closed position. The wear pad assembly includes a wear-resistant pad and a mounting bracket configured for attachment to the wear-resistant pad. The mounting bracket is configured to be securely clamped between the first and second elements of the work tool when in the closed position.

9 Claims, 3 Drawing Sheets

(56) References Cited

U.S. PATENT DOCUMENTS

| | | | | |
|---|---|---|---|---|
| 4,141,160 | A * | 2/1979 | Olson | E02F 9/28 172/719 |
| 4,189,854 | A * | 2/1980 | Haynes | 37/404 |
| 4,201,000 | A * | 5/1980 | Stanford | 37/407 |
| 4,269,275 | A * | 5/1981 | Cousin | 172/719 |
| 4,819,349 | A * | 4/1989 | Mensch | 37/407 |
| 5,012,599 | A * | 5/1991 | DeClair et al. | 37/444 |
| 5,471,770 | A | 12/1995 | Ferreira | |
| 5,596,825 | A * | 1/1997 | Von Schalscha | 37/407 |
| 5,611,157 | A * | 3/1997 | Ferreira | E01H 5/061 172/701.1 |
| 5,741,112 | A | 4/1998 | Lakin et al. | |
| 5,775,013 | A * | 7/1998 | Von Schalscha | 37/407 |
| 6,126,216 | A * | 10/2000 | Tollefson | 294/2 |
| 6,386,586 | B1 | 5/2002 | Ulery, Jr. et al. | |
| 6,860,044 | B2 * | 3/2005 | Keiper | 37/409 |
| 6,990,758 | B1 * | 1/2006 | Holmes et al. | 37/405 |
| 7,198,687 | B2 * | 4/2007 | Hill, III | E02F 3/8157 156/130.5 |
| D555,175 | S | 11/2007 | Shapiro et al. | |
| 7,617,619 | B2 | 11/2009 | Cox | |
| 7,617,666 | B1 * | 11/2009 | Marchese | 56/400.04 |
| 7,726,049 | B2 * | 6/2010 | Hill, III | E02F 3/8157 15/245 |
| 7,874,085 | B1 | 1/2011 | Winter et al. | |
| 2006/0145489 | A1 | 7/2006 | Shapiro et al. | |

FOREIGN PATENT DOCUMENTS

| | | | |
|---|---|---|---|
| EP | 1635002 | A | 3/2006 |
| GB | 1037590 | A | 7/1966 |
| GB | 2262116 | A | 9/1993 |
| WO | WO 2013101503 | | 7/2013 |

OTHER PUBLICATIONS

"Flip-Down Stabilizer Pad Assembly", Research Disclosure, Mason Publications, Hampshire, GB, No. 429, pp. 8-10 (2000).

* cited by examiner

WEAR PAD ASSEMBLY

CLAIM FOR PRIORITY

This application is a U.S. National Phase entry under 35 U.S.C. §371 from PCT International Application No. PCT/US2012/069700, filed Dec. 14, 2012, which claims benefit of priority of UK Patent Application No. 1122480.5, filed Dec. 30, 2011, all of which are incorporated herein by reference.

TECHNICAL FIELD

This disclosure is directed to a wear pad assembly for a work tool, and in particular to a wear pad assembly for use with work tools having movable elements, such as clamshell buckets.

BACKGROUND

Work machines, such as backhoe loaders, are commonly operated on hard finished surfaces such as tarmac work surfaces or roads. In order to stabilise the machine when working, rear stabiliser pads and a front end work tool, such as a bucket, are lowered to ground level. However, the forces on the surface resulting from the weight and movement of the machine can result in damage to the surface, which may lead to a penalty or re-work costs for the operator or contractor.

In order to address this problem, it is known to affix wear pads to the rear stabilisers, as described in U.S. Pat. No. 6,386,586. Such wear pads have a lower hardness than the road surface, and thus erode in preference thereto.

Similarly, wear pads may also be affixed to the front end work tool. US-A-2006/0145489 discloses an apparatus for protecting a floor or surface and a bucket or scoop from costly wear and/or damage during material handling operations, wherein the wear pad is configured to be bolted to a bucket or scoop.

However, the front end bucket is typically used for tasks such as lifting, digging, and loading, which tasks may be impeded by the presence of wear pads. Therefore, it would be desirable to have a wear pad which can be quickly attached to a work tool, such as a front end bucket, in a non-permanent manner.

SUMMARY

According to one aspect of the present disclosure there is provided a wear pad assembly for a work tool comprising first and second elements which are movable relative to each other from an open position to a closed position, said wear pad assembly comprising:

a wear-resistant pad; and a mounting bracket configured for attachment to the wear-resistant pad;

wherein the mounting bracket is configured to enable it to be securely clamped between the first and second elements of the work tool when in the closed position.

One exemplary embodiment of a wear pad assembly is as described with reference to, and as shown in the accompanying drawings.

DETAILED DESCRIPTION

Figure 1:
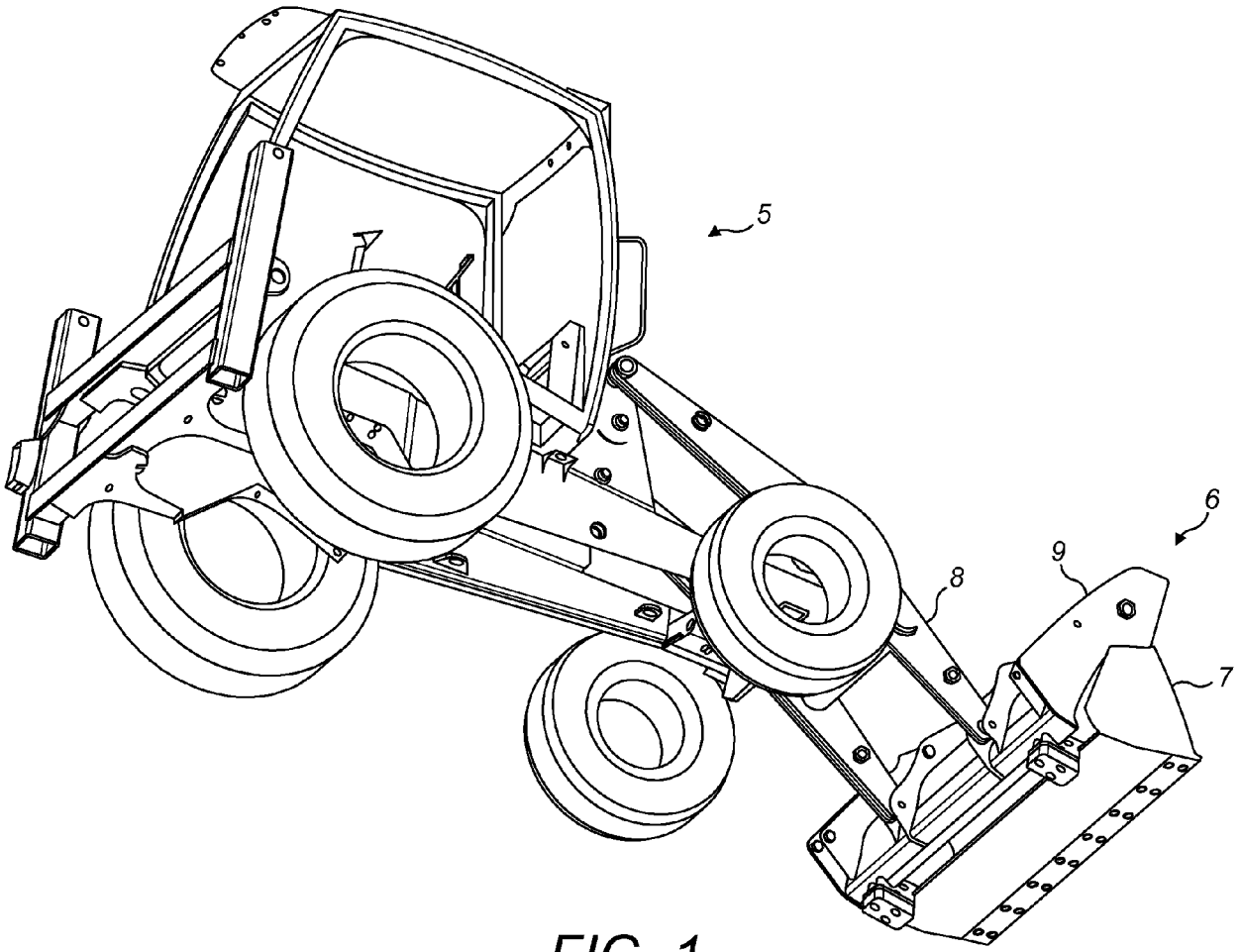
FIG. 1 is a perspective view of a work machine having the wear pad assembly according to the present disclosure secured thereto.

FIG. 1 illustrates a work machine 5 having a front end work tool 6, which in the illustrated embodiment is a clamshell bucket (also known in the field as a 'multi purpose' bucket). The work tool 6 may be pivotally connected to the work machine 5 via one or more linkage members 8. The work tool 6 may comprise first and second elements 7,9 which may be pivotally connected at their upper ends to achieve a jaw-like arrangement, for example via an hydraulically activated hinge connection. The first and second elements 7,9 may each comprise a bucket, or they may have any other suitable form. As the first and second elements 7,9 are closed, a clamping connection may be achieved between their lower ends. Conversely, by opening the first and second elements 7,9 the span between their lower ends may be widened.

The first element 7 may comprise a wear edge 22, which may be used for grading and/or levelling operations. The second element 9 may comprise a grading edge 21, which may be used for cutting, grading, and/or levelling operations. Both edges 21,22 may be made of a wear-resistant, hardened, and weldable material, such as a steel material.

Figure 3:
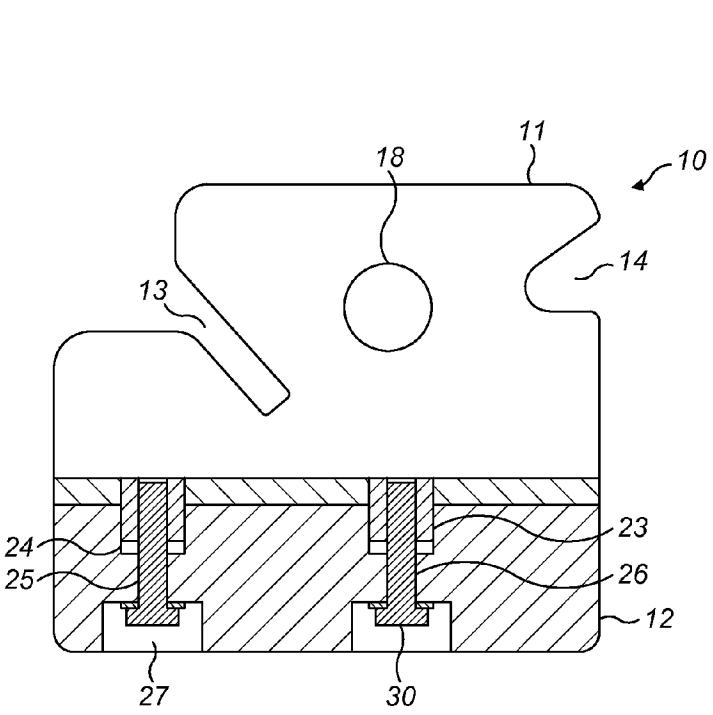
FIG. 3 is a cross-sectional view of the wear pad assembly of FIG. 2.
Figure 2:
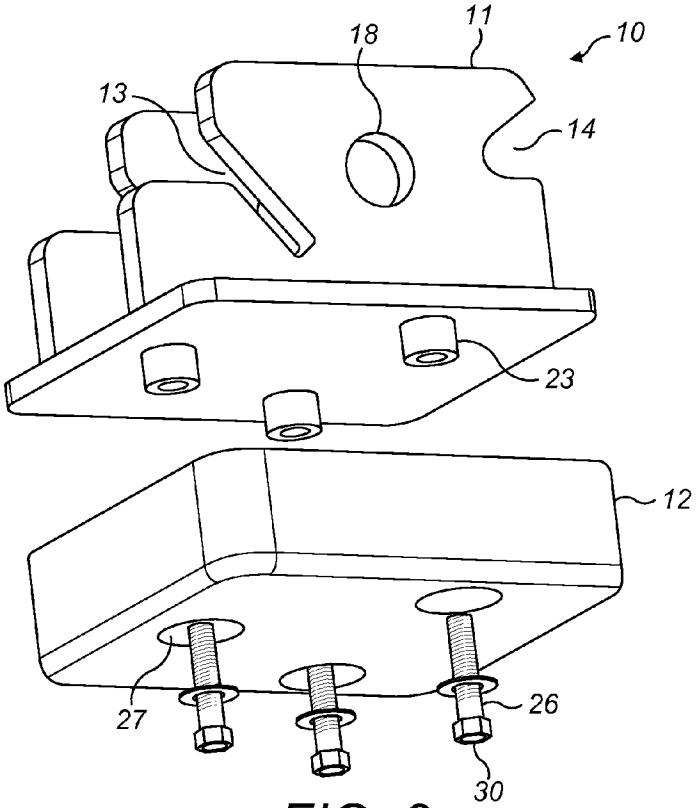
FIG. 2 is an exploded perspective view of a wear pad assembly according to the present disclosure.

FIGS. 2 and 3 illustrate a wear pad assembly 10 comprising two main components, namely a mounting bracket 11 and a wear-resistant pad 12.

Figure 5:
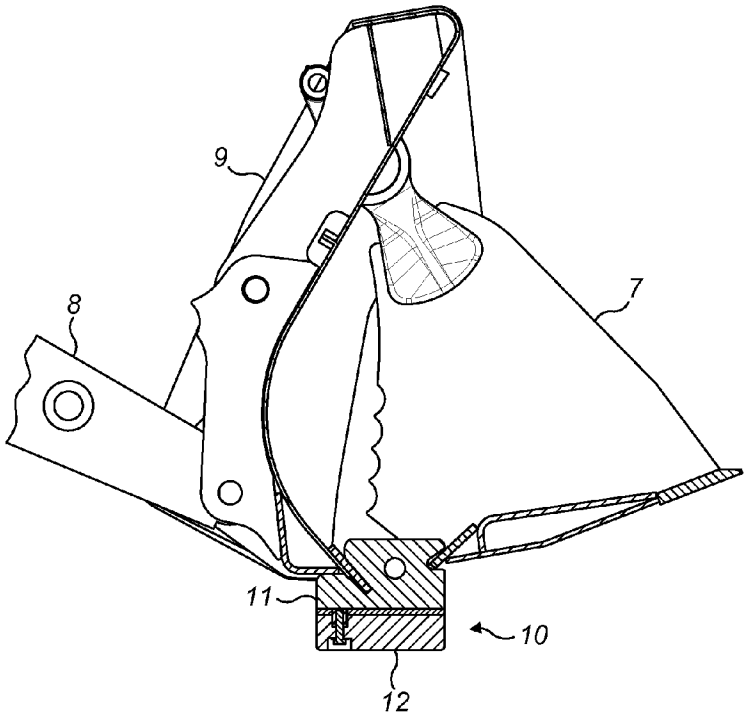
FIG. 5 is a side view of the wear pad assembly of FIGS. 2 to 4 located on a work tool of a work machine.
Figure 4:
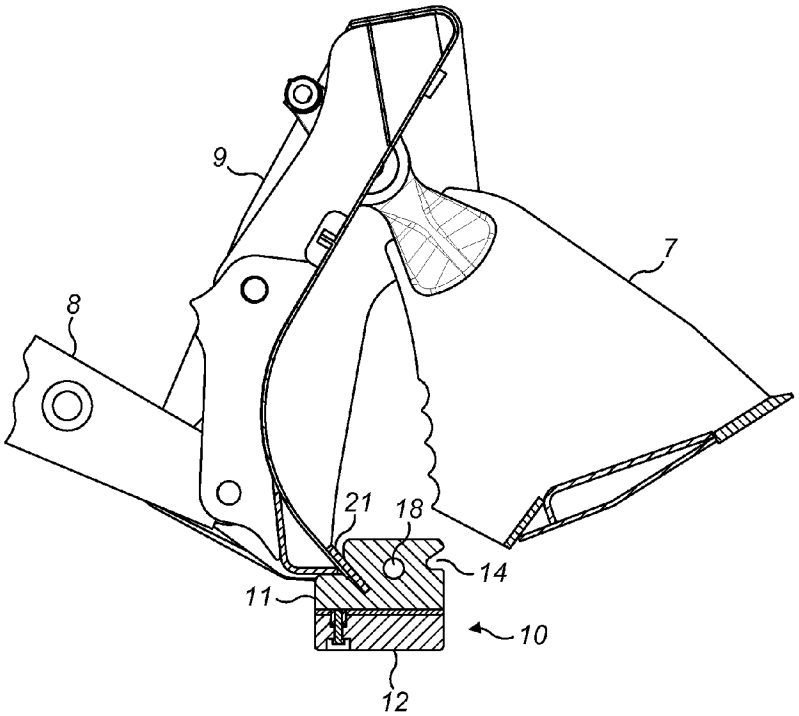
FIG. 4 is a side view of the wear pad of FIGS. 2 and 3 being located on a work tool of a work machine.

The mounting bracket 11 comprises first and second integrated profiled engagement slots 13,14 for the location and secure attachment of the wear pad assembly 10 to the work tool 6, as shown in FIGS. 4 and 5. The first engagement slot 13 may be dimensioned for engagement with the grading edge 21 of the second element 9, as shown in FIG. 4. The second engagement slot 14 is dimensioned for engagement with the wear edge 22 of the first element 7.

The mounting bracket 11 may be provided with shear lugs 23 for location of the pad 12 on the mounting bracket. The shear lugs 23 provide stability to the wear-resistant pad 12 to resist relative transverse movement between the mounting bracket 11 and the wear-resistant pad 12 when the work machine 5 is being operated.

The mounting bracket 11 may also be provided with an aperture 18, which may be used for lifting and storing the wear pad assembly 10. For example, the aperture 18 may be dimensioned such that a bar can be inserted therethrough in order to enable the wear pad assembly 10 to be lifted from a distance.

The mounting bracket 11 may be made from steel or any other suitable material. It may be manufactured by any suitable method, such as fabrication or casting.

The wear-resistant pad 12 may be provided with blind holes 24 for location of the wear-resistant pad 12 on the shear lugs 23. The wear-resistant pad 12 may also comprise through holes 25 for fasteners 26, such as bolts. The through holes 25 may be provided with counterbores 27 such that the heads 30 of the fasteners 26 sit flush with or below the level of the wear-resistant pad 12. The blind holes 24 and the through holes 25 may be coincident. This arrangement enables service replacement of the wear-resistant pad 12 as a singular item.

The wear-resistant pad 12 may be made of a wear-resistant compound, such as polyurethane or neoprene, or any suitable rubber material. The wear-resistant pad 12 may be manufactured from a moulding process. The surface area of the wear-resistant pad 12 is proportioned to account for front end machine weight distribution and surface pressure.

INDUSTRIAL APPLICABILITY

The wear pad assembly has industrial applicability in the field of work machines, and may be used on a variety of different work machines, including backhoe loaders, which have a work tool comprising two elements which are movable relative to each other, such as a clamshell bucket.

The wear pad assembly 10 is attached and secured to the work tool 6 when it is required to lower the work tool 6 to the ground to act as a stabilising leg for the work machine 5. First, the work tool 6 is placed in an open configuration, with a gap between the two edges 21,22 of the two elements 7,9. The first engagement slot 13 is located on the edge 21 of the second element 9, as shown in FIG. 3. The two elements 7,9 of the work tool 6 are subsequently closed together such that the edge 22 of the first element 7 locates in the second engagement slot 14, thereby locating and securing the wear pad 10 to the work tool 6 through a clamping action.

The wear pad assembly according to the disclosure enables a machine operator to easily and quickly fit the wear pad to a front-end bucket.

The invention claimed is:

1. A machine having a tool comprising first and second elements that are pivotally connected to each other at first ends of each of the first and second elements such that opposite second ends of the first and second elements are movable relative to each other from an open position with a wider span between the second ends to a closed position with a smaller span between the second ends, and further comprising a wear pad assembly, said wear pad assembly comprising:

a wear-resistant pad; and a mounting bracket configured for attachment to the wear-resistant pad;

wherein the mounting bracket includes a first engagement slot on a first portion of the mounting bracket and a second, separate engagement slot on a second portion of the mounting bracket, wherein the first engagement slot is engaged with the second end of the first element of the tool and the second engagement slot is engaged with the second end of the second element of the tool when the first and second elements of the tool are in the closed position.

2. A machine according to claim 1, wherein the tool is a bucket.

3. A machine according to claim 2, wherein the bucket is a clamshell bucket.

4. A machine comprising:

a tool, the tool comprising a first element and a second element, the first and second elements being pivotally connected to each other at first ends of each of the first and second elements such that opposite second ends of the first and second elements are movable relative to each other from an open position with a wider span between the second ends to a closed position with a smaller span between the second ends; and a wear pad assembly, said wear pad assembly comprising:

a wear-resistant pad; and a mounting bracket configured for attachment to the wear-resistant pad and to the first and second elements of the tool;

wherein the mounting bracket includes a first opening on a first portion of the mounting bracket and a second, separate opening on a second portion of the mounting bracket, wherein the first opening is engaged with an edge of the second end of the first tool element and the second opening is engaged with an edge of the second end of the second tool element when the first and second elements of the tool are in the closed position.

5. The machine of claim 4, wherein the first opening is an engagement slot.

6. The machine of claim 4, wherein the second opening is an engagement slot.

7. The machine of claim 4, wherein the mounting bracket comprises an aperture.

8. The machine of claim 4, wherein the mounting bracket further comprises one or more shear lugs.

9. The machine of claim 8, wherein the wear pad assembly comprises one or more blind holes for location of the wear-resistant pad on the shear lugs of the mounting bracket.

* * * * *